US007905213B2

(12) United States Patent
Fokkelman et al.

(10) Patent No.: US 7,905,213 B2
(45) Date of Patent: Mar. 15, 2011

(54) ADAPTIVE POSITIONING METHOD FOR AN ACTUATOR

(75) Inventors: Joris Fokkelman, Tegernheim (DE); Dirk Schneider, Pfaffenhofen (DE)

(73) Assignee: Continental Automotive GmbH, Hannover (DE)

( * ) Notice: Subject to any disclaimer, the term of this patent is extended or adjusted under 35 U.S.C. 154(b) by 240 days.

(21) Appl. No.: 12/280,065

(22) PCT Filed: Feb. 19, 2007

(86) PCT No.: PCT/EP2007/051555

§ 371 (c)(1),
(2), (4) Date: Oct. 16, 2008

(87) PCT Pub. No.: WO2007/096327

PCT Pub. Date: Aug. 30, 2007

(65) Prior Publication Data

US 2009/0138183 A1 May 28, 2009

(30) Foreign Application Priority Data

Feb. 21, 2006 (DE) ..... 10 2006 008 051

(51) Int. Cl.
*F02D 41/00* (2006.01)

(52) U.S. Cl. ..... 123/361; 123/399

(58) Field of Classification Search ..... 123/399, 123/339.1, 361, 337; 701/110
See application file for complete search history.

(56) References Cited

U.S. PATENT DOCUMENTS

| | | | | | |
|---|---|---|---|---|---|
| 4,132,195 | A | * | 1/1979 | Bianchi et al. | 123/482 |
| 4,226,295 | A | * | 10/1980 | Rembold et al. | 180/335 |
| 4,441,471 | A | * | 4/1984 | Kratt et al. | 477/111 |
| 4,455,978 | A | * | 6/1984 | Atago et al. | 123/339.19 |
| 4,622,936 | A | | 11/1986 | Junginger et al. | 123/399 |
| 4,827,937 | A | | 5/1989 | Kohler et al. | 123/486 |
| 4,849,896 | A | | 7/1989 | Biirk et al. | 364/431.07 |
| 5,002,032 | A | * | 3/1991 | Kolberg | 123/399 |
| 5,014,666 | A | * | 5/1991 | Westenberger | 123/339.15 |
| 5,033,431 | A | | 7/1991 | Poirier et al. | 123/339 |
| 5,131,360 | A | * | 7/1992 | Muschalik | 123/339.15 |
| 5,606,951 | A | * | 3/1997 | Southern et al. | 123/399 |
| 2001/0005987 | A1 | * | 7/2001 | Bolz et al. | 60/285 |
| 2004/0231641 | A1 | | 11/2004 | Wind | 123/396 |

FOREIGN PATENT DOCUMENTS

| | | | |
|---|---|---|---|
| DE | 35 10 176 | A1 | 2/1986 |
| DE | 35 05 965 | A1 | 8/1986 |
| DE | 39 26 031 | C1 | 11/1990 |
| DE | 36 12 905 | C2 | 11/1993 |
| DE | 40 05 255 | C2 | 11/2002 |
| DE | 103 11 019 | A1 | 9/2004 |
| EP | 1 517 023 | A1 | 7/2003 |

* cited by examiner

*Primary Examiner* — John T Kwon
(74) *Attorney, Agent, or Firm* — King & Spalding L.L.P.

(57) ABSTRACT

In an adaptive positioning method for an actuator, in particular, for a throttle butterfly on an internal combustion engine, during the adaptive positioning method, after a request for a set position and selection of a pilot value a corresponding pilot position for the actuator is adopted. The pilot position is adjusted until said position corresponds to the requested set position. The control value actually required or this set position is subsequently measured and recorded as corrected pilot value for the corresponding set position.

14 Claims, 3 Drawing Sheets

ADAPTIVE POSITIONING METHOD FOR AN ACTUATOR

CROSS-REFERENCE TO RELATED APPLICATIONS

This application is a U.S. national stage application of International Application No. PCT/EP2007/051555 filed Feb. 19, 2007, which designates the United States of America, and claims priority to German application number 10 2006 008 051.3 filed Feb. 21, 2006, the contents of which are hereby incorporated by reference in their entirety.

TECHNICAL FIELD

The present relates to an adaptive positioning method for an actuator, in particular for a throttle butterfly on an internal combustion engine.

BACKGROUND

Throttle butterflies with position feedback in internal combustion engines are operated with the help of controlling and adjusting algorithms. These algorithms ensure that the set position for the throttle butterfly requested by the driver is adjusted quickly and precisely. This is preset, for example by displacement of the accelerator by the driver of a motor vehicle.

The set position of the throttle butterfly is characterized by a control value. This control value is made up of a pilot value and a regulator intervention of a fed-back regulator on the throttle butterfly. Therefore, in order to regulate the position of the throttle butterfly or of an actuator quickly, it may be advantageous to know how the control value and the position resulting therefrom react to each other. A precisely known behavior means that the part of the fed-back adjustment on the control value is reduced in favor of the pilot control.

The pilot control may have the advantage over adjustment that it is proactive and inherently allows the throttle butterfly or the actuator to be adjusted more quickly.

Manufacturing tolerances, environmental influences and aging influence the relation between the pilot value and the position of the actuator or the throttle butterfly position. Therefore the pilot value must be adapted in order to know exactly the pilot value required for a flap position.

DE-A-36 12 905 C2 discloses an adaptive adjustment, in which the sensor values pertaining to the limit stops are learned. A linear interpolation is performed between the sensor values of the limit stops in order to determine the value pairs that lie therebetween. DE-A-35 10 176 A1, DE-A-40 05 255 C2 and DE-A-36 12 905 C2 describe a further control alternative. Here, for example, the control value for a requested set position is taken from an engine operating map. If the position achieved by the control value does not correspond with the set position, then a corresponding readjustment is made. The readjustment is recorded in a correction characteristic curve and is arranged downstream of the engine operating map in the further method. This is designed to reduce the time and effort needed for the readjustment. This correction characteristic curve also takes into account marginal conditions such as the temperature for example.

SUMMARY

The disadvantage of the above methods is that they require too much time in order to achieve the set position of the actuator, in particular that of the throttle butterfly, set by the driver. A positioning method that is more efficient compared to prior art can be provided.

According to an embodiment, an adaptive positioning method for an actuator, in particular for a throttle butterfly on an internal combustion engine, may comprise the following steps: a) Presetting a set position by a set value and selection of a pilot value for the actuator to achieve the set position, b) adjusting a pilot position of the actuator according to the pilot value and comparing the pilot position of the actuator with the set position, c) adjusting the pilot position until the set position that corresponds to an adapted control value is reached, and d) recording the adapted control values as a pilot value as a function of the set position.

According to a further embodiment, the positioning method may comprise the additional steps: storing the set position as a function of the adapted control value and inverting this relation in order to obtain the adapted control value as a function of the set value representing the set position. According to a further embodiment, the adapted control values can be recorded at a plurality of predefined points in the regulating range of the actuator. According to a further embodiment, the positioning method may comprise the additional step of storing the adapted control value in an engine operating map. According to a further embodiment, the engine operating map may comprise the adapted control value as a function of the set value and at least one boundary condition of the actuator, in particular pressure difference on the throttle butterfly, temperature and air-mass flow rate. According to a further embodiment, several set values may be specifically preset one after another, so that characteristic points of a regulating range of the actuators can be captured and the pilot values can be adapted to these.

BRIEF DESCRIPTION OF THE DRAWINGS

Embodiments are described in greater detail with reference to the attached drawing, in which.

DETAILED DESCRIPTION

Figure 1:
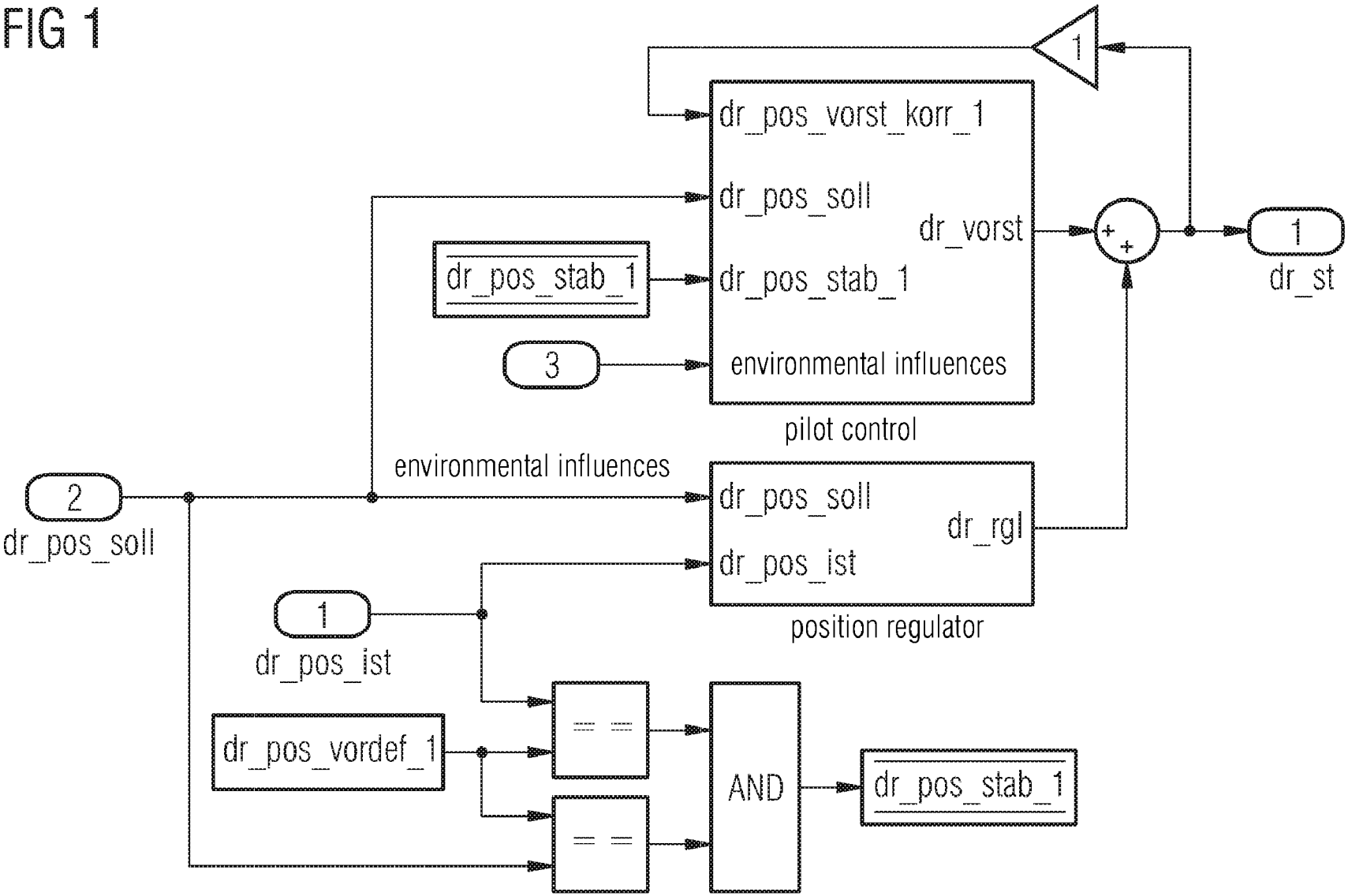
FIG. 1 illustrates an embodiment of the method.

The adaptive positioning method for an actuator, in particular for a throttle butterfly on an internal combustion engine, may comprise the following steps: presetting a set position by a set value and selection of a pilot value for the actuator in order to achieve the set position, adjusting a pilot position of the actuator according to the pilot value and comparing the pilot position of the actuator with the set position, adjusting the pilot position until the set position that corresponds to an adapted control value is reached, and recording the adapted control values as a pilot value as a function of the set position.

In order to describe the adaptive positioning method, reference is made to adjusting a throttle butterfly on an internal combustion engine in a motor vehicle by way of example. The driver of the motor vehicle displaces the accelerator with his foot, which presets a set position of the throttle butterfly via a set value. In order to achieve this set position as quickly as possible, the motor-control takes a pilot value assigned to the set position from a characteristic map for example. This pilot value is used to achieve the set position of the throttle butterfly as quickly as possible without additional, time-consuming regulating interventions. After the pilot position of the throttle butterfly which corresponds to the pilot value has been achieved, said pilot position is compared with the set position in order to adjust the throttle butterfly exactly to the desired set position. The result of this adjustment when the set position and pilot position correspond is a measured adapted control value, which presets the desired set position. In order to increase the efficiency of the adaptive positioning method, the adapted control value is recorded or stored as pilot value as a function of the set position. As a result when the driver next requests the same set position, a readjustment of the pilot value becomes redundant because now the pilot value already corresponds to the adapted control value for achieving this set position. However, if the comparison step again delivers no match between the set position and the pilot position, the pilot value is readjusted again and hence also the adaptive control value.

According to an embodiment of the present positioning method the set position is stored as a function of the adapted control value and this relation is inverted in order to obtain the adapted control value as a function of the set value representing the set position.

Moreover, it may be preferred to specifically adopt a plurality of predefined set positions in the regulating range of the actuator or of the throttle butterfly, to determine the correspondingly adapted control values and to record said control values as new pilot values. In this way, crucial points of the regulating range of the actuator are specifically selected and processed as interpolation nodes for the adaptive positioning method. This allows any number of pilot values relating to a specific actuator to be defined so that the future regulating load is reduced.

According to a further embodiment of the present method, the adapted control values are stored in an engine operating map. Likewise it may be preferred that the adapted control value is stored within this engine operating map as a function of the set value and at least one boundary condition of the actuator, in particular a pressure reference on the throttle butterfly, a temperature and/or an air-mass flow rate.

The present invention discloses an adaptive positioning method for an actuator, which is explained using the exemplary embodiment of a throttle butterfly on an internal combustion engine of a motor vehicle.

By displacing the accelerator, a driver of the motor vehicle requests a specific torque from the internal combustion engine. This torque corresponds to an opening angle or a set position dr_pos_soll of the throttle butterfly, that can be identified with a set value. A motor-control of the internal combustion engine converts this set value into the set position dr_pos_soll of the throttle butterfly for example. The relation between the set value and the position of the throttle butterfly that can be obtained using said set value is, however, not ideal, so that, for example, manufacturing tolerances, drift, aging and/or thermal fluctuations prevent the set position being achieved immediately with only the set value being given. Therefore, in order to achieve the set position, a pilot value is first selected, with which pilot value the throttle butterfly can already be guided or placed as near as possible to the set position. With the pilot value, a pilot position is thus adopted or adjusted near the set position.

In a comparison step running in combination with a regulating step, the pilot position is compared to the requested set position. A position regulator of the throttle butterfly (cf. FIG. 1) implements a regulating intervention until the pilot position corresponds to the requested set position.

In order to minimize the time required for the compare and regulating step, after the pilot position has been adjusted into the set position, the required control value for this position is measured as the adapted control value. Subsequently, the pilot value of this set position is overwritten and stored by the adapted control value dr_st corresponding to this set position. The adapted control value can also be called the corrected pilot value dr_pos_vorst_korr.

In order to ensure a quick and precise position adjustment of the throttle butterfly, not just the adapted control values of the limit stops or of the positions near the limit stops of the throttle butterfly are important. From a global point of view, intermediate positions are in part more important, as here the effective cross section of the throttle butterfly, which cross section is the deciding factor for the gas throughput, changes with in part large position dependent gradients compared to the above limit stops. For this reason, with targeted adaption of the pilot value it is possible to carry out a more effective adjustment on more than two interpolation nodes in the regulating range of the throttle butterfly as compared with previous solutions. Therefore, at least three or a plurality of positions in the regulating range of the throttle butterfly are selected as predefined points. These points are characterized in that they frequently represent adopted positions of the throttle butterfly or in that one expects a strong gas throughput gradient between the positions. With reference to FIG. 1 position 1 dr_pos_vordef_l represents one of these predefined points.

If the predefined position 1 dr_pos_vordef_l is requested by the driver as set position dr_pos_soll or is specifically preset by the motor-control, the corresponding pilot value dr_vorst first presents a pilot position of the throttle butterfly. Different proportions, influences, conditions can be taken into consideration in the pilot value dr_vorst, such as, for example, environmental influences, the presence of a stable operating point of the throttle butterfly dr_pos_stab_l, the preset set position dr_pos_soll and the previously adapted control value and/or the corrected pilot value dr_pos_vorst_korr_l (see below). Therefore, the pilot value dr_vorst and a regulator element dr_rgl enter the control value dr_st to achieve the set position dr_pos_soll.

The regulator element dr_rgl of the present method compares the set position of the throttle butterfly dr_pos_soll with the actual position of the throttle butterfly dr_pos_ist and regulates until the actual position dr_pos_ist matches the set position dr_pos_soll. Thus from the combination of the pilot value dr_vorst and the regulator part dr_rgl there results the adapted control value dr_st. This can, for example, be measured as an actual control value as soon as the requested set position is reached. After an optional filtering, the adapted control value dr_st is recorded as the new or corrected pilot value dr_pos_vorst_korr_l for the set position 1 in the non-volatile memory. The value to be stored can be preferably the result of a weighted average of the old value and the value now present. The aim of the filtering is to minimize noise and eliminate shot-to-shot deviations.

The result of the present method is an adapted stored correlation between the throttle butterfly position dr_pos_ist and the adapted control value or the corrected pilot value dr_pos_vorst_korr. The throttle butterfly position corresponds at this point in the method both to the requested set position dr_pos_soll and also the actual position dr_pos_ist. The correlation is illustrated in FIG. 2, in which the arrows illustrate possible deviations based on several measurements at the same set position.

Figure 2:
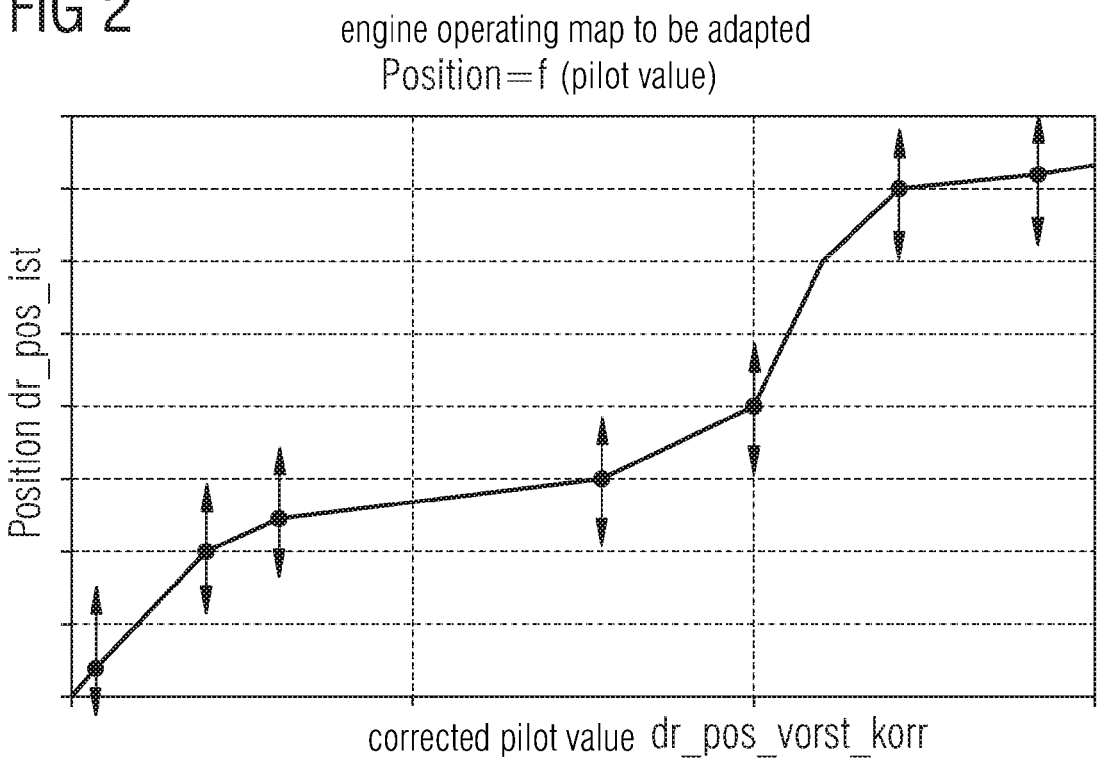
FIG. 2 shows in simplified form the correlation between the actual position of the throttle butterfly and the corrected pilot value of the throttle butterfly.
Figure 3:
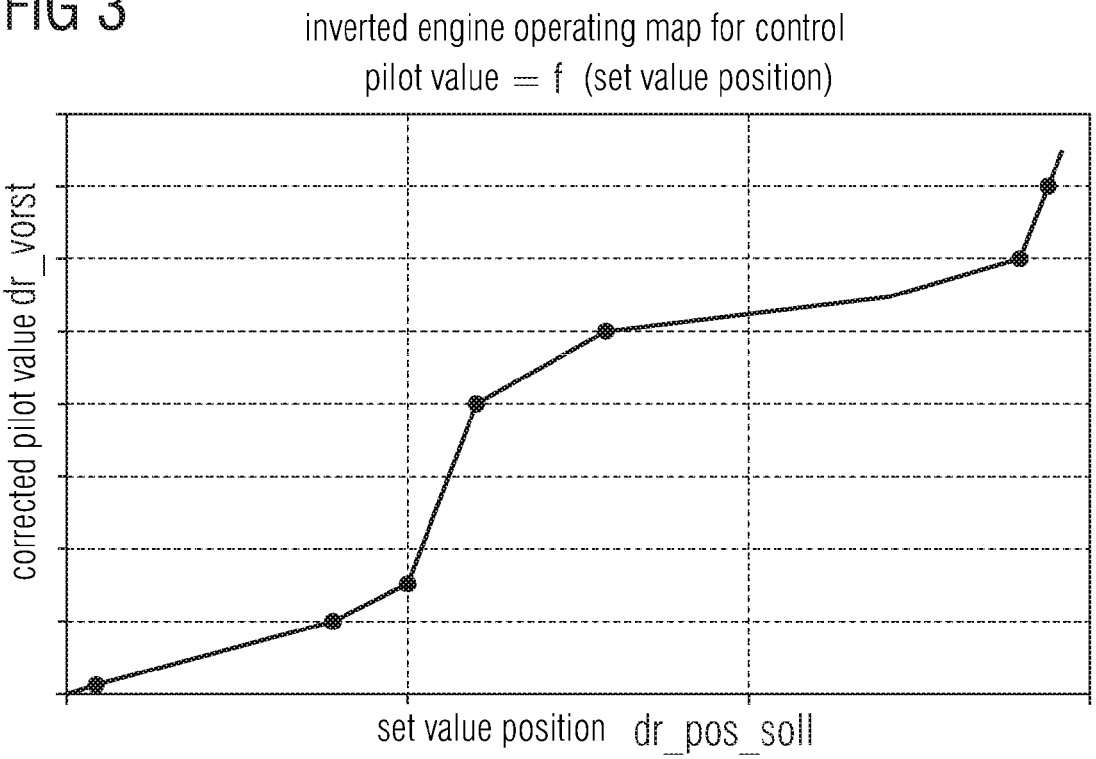
FIG. 3 contains the inverted relation from FIG. 2, which relation represents the pilot value as a function of a set value corresponding to a requested set position of the throttle butterfly.

If the correlation from FIG. 2 is inverted and applied to the set position dr_pos_soll of the throttle butterfly requested by the driver, the element of regulator intervention dr_rgl is minimized. This relation is shown in FIG. 3. FIG. 3 shows the pilot value dr_vorst on the y-axis, which is solely composed of the corrected pilot value dr_pos_vorst_korr or the adapted control value or of this value and other influences (see above). The pilot value dr_vorst is applied according to the set value of the requested set position dr_pos_soll.

For increased precision, the adapted stored correlations can be preferably recorded according to pressure difference, temperature and/or mass flow rate on the throttle butterfly. In addition, in accordance with one embodiment, an interpolation is applied over the measuring points already available to calculate the corrected pilot value from the set value of the requested set position. The interpolation nodes for this interpolation are either predefined (cf. the above application of the method to the predefined Position 1 dr_pos_vordef_l) or are continuously optimized using a subordinated optimization routine. According to a further embodiment, in addition the environmental conditions are also used as interpolation nodes in order to carry out a multidimensional Interpolation.

According to a further process variant of this method, predefined pilot values are inserted at at least three points and the thereby ensuing position value is measured. In this way one also arrives at a correlation between pilot value and position of the throttle butterfly.

Using the above method, the pilot control of the throttle butterfly is thus improved so that overall, the activation of the throttle butterfly can be implemented faster. The adjustment serves then exclusively as a correction instance, which, accordingly, can then be dimensioned more exactly. It can also be of advantage that the adaptive character of this positioning method compensates in a more cost-effective way for possible manufacturing tolerances of the throttle butterfly or of its aging.

Figure 4:
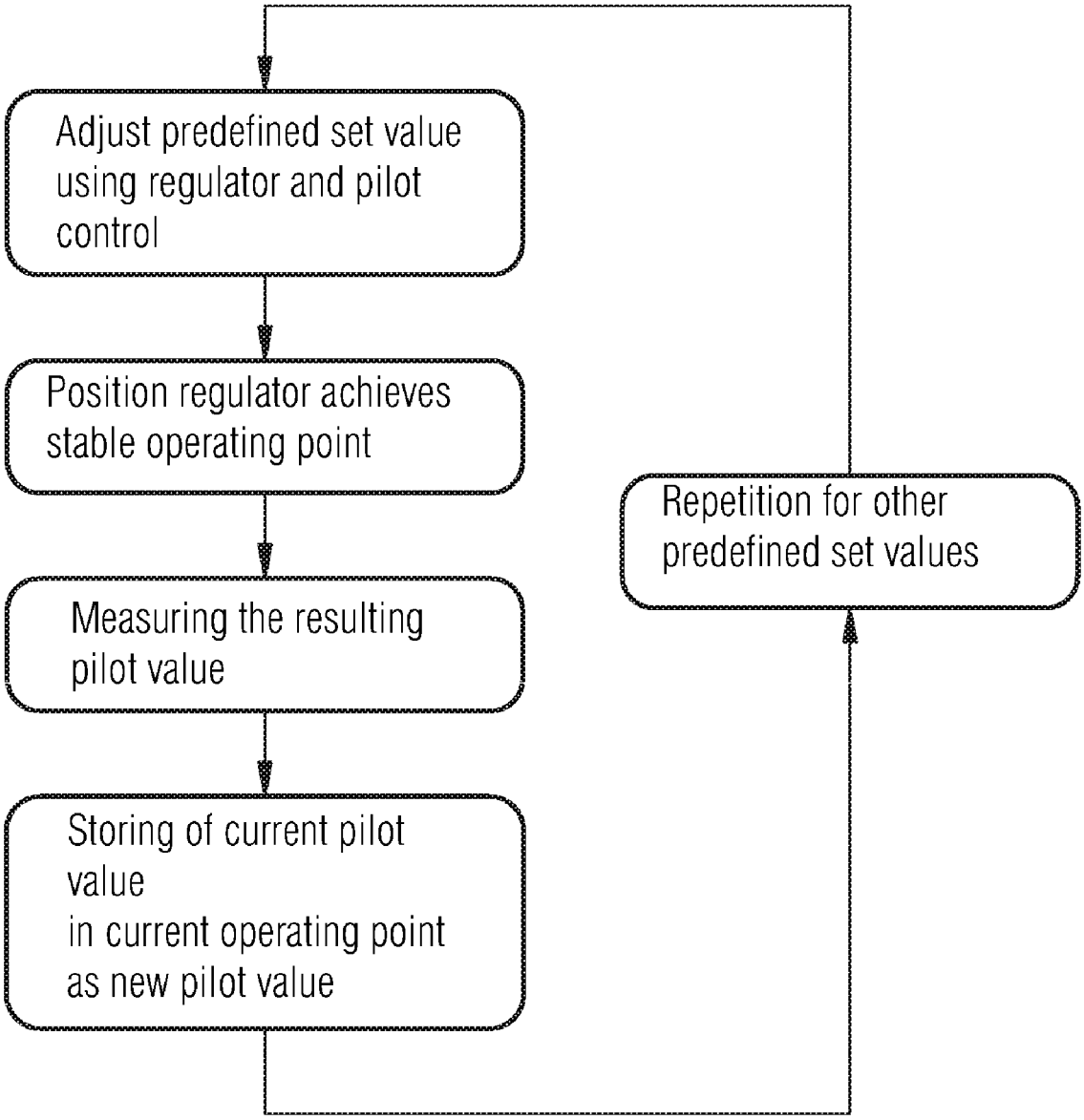
FIG. 4 shows a simplified flow chart of an embodiment of the present method.

FIG. 4 shows again in a schematic overview a flow chart of the adaptive positioning method according to the last mentioned function variant. According to that, a predefined set value of a throttle butterfly position is first adjusted to the requested set position with the help of known pilot values and a position regulator. After the position regulator has reached a stabile operating point of the throttle butterfly, the control value resulting from pilot control und position adjustment is measured. This control value, which can be referred to as the current control value in the current operating point of the throttle butterfly, is stored as the new pilot value according to the set position adopted. In this way the existing pilot control is adapted. After this step has been completed, the individual procedure steps for further predefined set values or set positions are repeated. Thereby a plurality of interpolation nodes are specifically generated in the regulating range of the throttle butterfly, from which nodes, for example, by interpolation a correlation can be derived between the corrected pilot value and the set values of the throttle butterfly across the entire regulating range of the throttle butterfly.

The invention claimed is:

1. An adaptive positioning method for an actuator, comprising the following steps:

a) receiving from a driver a request for a set position of the actuator and selecting a pilot value for the actuator to achieve the set position, b) adopting a pilot position of the actuator according to the pilot value and comparing the pilot position of the actuator with the set position, c) adjusting the pilot position until the requested set position is reached, d) determining an adapted control value corresponding to the adjusted pilot position, e) recording the adapted control values as a new pilot value for the set position, and f) repeating steps a) through e) for a plurality of different set positions in a regulating range of the actuator.

2. The positioning method according to claim 1, comprising the additional steps:

storing the set position as a function of the adapted control value and inverting this relation in order to obtain the adapted control value as a function of the set value representing the set position.

3. The positioning method according to claim 1, comprising the additional step:

storing the adapted control value in an engine operating map.

4. The positioning method according to claim 3, wherein the engine operating map comprises the adapted control value as a function of the set value and at least one boundary condition of the actuator.

5. The positioning method according to claim 1, wherein several set values are specifically preset one after another, so that characteristic points of a regulating range of the actuators are captured and used for adapting the pilot values.

6. The positioning method according to claim 3, wherein the engine operating map comprises the adapted control value as a function of the set value and at least one of a pressure difference on the throttle butterfly, temperature or air-mass flow rate.

7. The positioning method actuator according to claim 1, wherein the method is used for a throttle butterfly on an internal combustion engine.

8. An system for adaptive positioning of an actuator, comprising:

means for receiving from a driver a request for a set position of the actuator and selecting a pilot value for the actuator to achieve the set position, means for adopting a pilot position of the actuator according to the pilot value and comparing the pilot position of the actuator with the set position, means for adjusting the pilot position until the requested set position is reached, means for recording the adapted control values as a new pilot value for the set position, and means for repeating the receiving, adopting, adjusting, and recording functions for a plurality of different set positions in a regulating range of the actuator.

9. The system according to claim 8, comprising:

means for storing the set position as a function of the adapted control value and for inverting this relation in order to obtain the adapted control value as a function of the set value representing the set position.

10. The system according to claim 8, comprising:

means for storing the adapted control value in an engine operating map.

11. The system according to claim 10, wherein the engine operating map comprises the adapted control value as a function of the set value and at least one boundary condition of the actuator.

12. The system according to claim 10, wherein the engine operating map comprises the adapted control value as a function of the set value and at least one of, a pressure difference on the throttle butterfly, temperature or air-mass flow rate.

13. The system according to claim 8, wherein several at values are specifically preset one after another, so that characteristic points of a regulating range of the actuators can be captured and the pilot values can be adapted to these.

14. The system according to claim 8, wherein the actuator is a throttle butterfly in an internal combustion engine.

* * * * *